US009174793B2

(12) United States Patent
Macchi

(10) Patent No.: US 9,174,793 B2
(45) Date of Patent: Nov. 3, 2015

(54) RIGID CARTRIDGE FOR COFFEE AND SOLUBLE PRODUCTS FOR PREPARING BEVERAGES

(75) Inventor: Edoardo Macchi, Ossona (IT)

(73) Assignee: MITACA S.R.L., Frazione Marivaglio (Milan) (IT)

( * ) Notice: Subject to any disclaimer, the term of this patent is extended or adjusted under 35 U.S.C. 154(b) by 953 days.

(21) Appl. No.: 13/376,211

(22) PCT Filed: May 26, 2010

(86) PCT No.: PCT/EP2010/057195

§ 371 (c)(1),
(2), (4) Date: Dec. 5, 2011

(87) PCT Pub. No.: WO2010/139575

PCT Pub. Date: Dec. 9, 2010

(65) Prior Publication Data

US 2012/0118166 A1 May 17, 2012

(30) Foreign Application Priority Data

Jun. 4, 2009 (IT) ..... MI2009A0975

(51) Int. Cl.
*A47J 31/06* (2006.01)
*B65D 85/804* (2006.01)

(52) U.S. Cl.
CPC ..... *B65D 85/8043* (2013.01)

(58) Field of Classification Search
CPC ..... B65D 85/8043
USPC ..... 99/295; 210/512.1
See application file for complete search history.

(56) References Cited

U.S. PATENT DOCUMENTS

| | | | | |
|---|---|---|---|---|
| 8,256,343 | B2 * | 9/2012 | Noordhuis | 99/300 |
| 2007/0221570 | A1 * | 9/2007 | Aregger et al. | 210/512.1 |

FOREIGN PATENT DOCUMENTS

| | | | |
|---|---|---|---|
| EP | 1 364 605 | A1 | 11/2003 |
| EP | 1 555 218 | A1 | 7/2005 |
| EP | 1 579 793 | A1 | 9/2005 |
| GB | 2 454 656 | A | 5/2009 |

OTHER PUBLICATIONS

International Search Report, dated Jul. 30, 2010, from corresponding PCT application.

* cited by examiner

*Primary Examiner* — Jianying Atkisson
(74) *Attorney, Agent, or Firm* — Young & Thompson

(57) ABSTRACT

A cartridge (1) for coffee or soluble products for producing a beverage, includes a container (2) able to contain the coffee or soluble product, a lid (6) disposed over the container so as to define a top wall for entry into the container of the hot water under pressure for formation of the beverage, a filter (4) able to be positioned inside the container above a bottom wall (20) of the container through which the beverage flows out, wherein the bottom wall of the container has a weakened, less thick central area (22), suitable to be broken by mechanical elements or by the pressure of the liquid inside the cartridge to allow delivery of the beverage, there being provided a plurality of concentric, spiral-shaped channels, ending in the less thick central area, able to cause a swirling movement of the beverage, with the consequent formation of a dense froth.

11 Claims, 2 Drawing Sheets

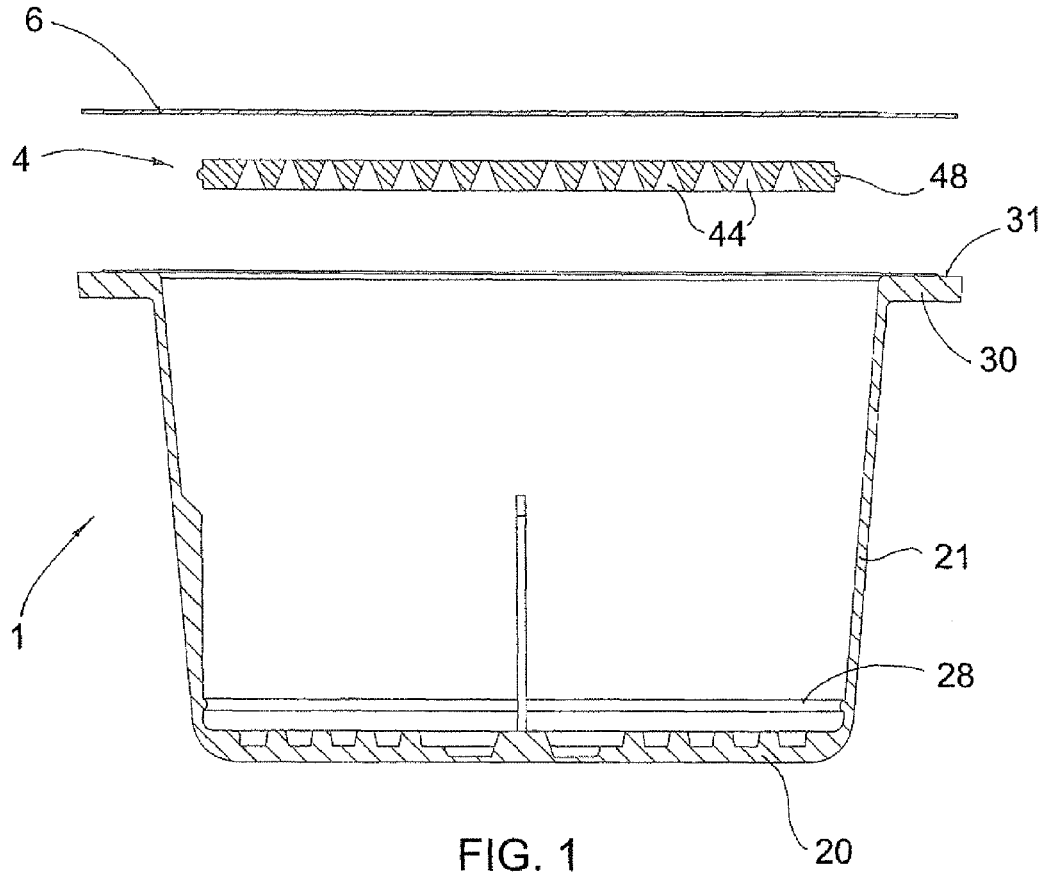
FIG. 1
FIG. 2
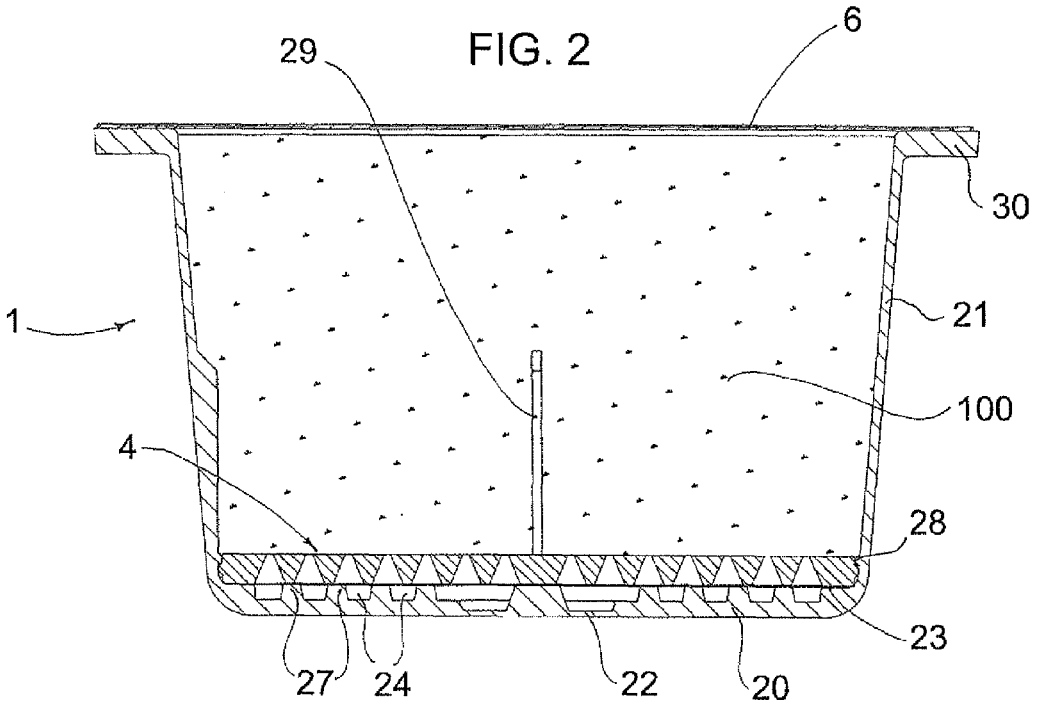

RIGID CARTRIDGE FOR COFFEE AND SOLUBLE PRODUCTS FOR PREPARING BEVERAGES

The present invention refers to a cartridge or capsule for containing coffee or soluble products in general, such as for example barley, powdered milk, tea, chamomile, herb teas and the like, for preparing the respective beverages.

In the rest of this description, it being understood that the cartridge according to the invention can be used for the preparation of the various beverages mentioned above, specific reference will be made to coffee, the product for which the cartridge according to the invention has been particularly designed.

Essentially two types of cartridge for containing coffee in powder or fine granules are widely available on the market: rigid cartridges and flexible cartridges.

The cartridge according to the invention is of the rigid type, so reference will be made hereunder only to this type of cartridge of the prior art.

Rigid cartridges are substantially cylindrical in shape, comprise two half-shells of rigid plastic material, heat-sealed or hot-glued together, and enclose on their inside the coffee in powder placed on a filter in contact with the bottom wall of the cartridge.

Normally the bottom wall of the cartridge is perforated, whilst the upper wall may or may not be perforated, depending upon the type of apparatus used for extraction of the beverage, that is, whether it is with perforation of the upper wall or with simple injection of hot water under pressure, which, by passing through the powder product, enters the cartridge and captures its aromas, passes through the filter which retains the powder product, and flows out through the holes provided in the bottom wall, thus producing the beverage which is caught in an appropriate glass or cup beneath.

This type of rigid cartridge with a perforated bottom wall on the one hand holds the drawback that the product inside it is exposed to the outside environment and can thus lose its fragrance if it is not tightly closed in a further protective package, and on the other hand that during infusion it is not possible to reach adequate water pressures, which has repercussions on the quality of the beverage obtained.

There also exist cartridges with a solid bottom wall, which is pierced by the point of the beverage extraction apparatus during delivery of the beverage.

Such a cartridge is described, for example, in patent EP 1364605, the content of which is incorporated herein by reference.

Such a cartridge makes it possible to obtain adequate pressurization before its bottom is perforated, and thus to overcome at least in part the drawbacks reported above.

Similar results are obtained with the cartridge described in EP 1555218, in the name of the same applicant, I.TA.CA S.r.L., the bottom wall of which is completely closed and has a weakened central portion with etchings arranged in cross, able to open when a pre-set pressure is reached, allowing the beverage to flow out.

However, the applicant, having noted that the beverage thus obtained with said cartridges is poorly emulsified, has carried out numerous studies aimed at improving the quality thereof.

Object of the invention is precisely to provide such a cartridge for coffee that makes it possible to obtain a beverage that is more emulsified and therefore more creamy, improving its quality compared with those obtainable up to now.

Another object of the invention is to provide such a cartridge for coffee that is simple and cheap to make and that can be used in various types of traditional beverage dispensing machines.

These objects are achieved according to the invention with the coffee cartridge having the characteristics of appended independent claim 1.

Advantageous embodiments of the invention are apparent from the dependent claims.

Essentially, the cartridge of the rigid type according to the invention has on the bottom wall a plurality of concentric spiral-shaped channels which go from the peripheral edge of the bottom wall to a weakened, less thick central part.

The weakened central part may advantageously be doughnut-shaped or annular and is perforated with mechanical means during the beverage extraction step, or alternatively it may have etchings which open causing said weakened wall to be knocked out when an adequate water pressure is reached inside the container.

The provision of such spiral-shaped channels on the bottom of the cartridge produces a swirling movement of the liquid during delivery, allowing a creamy beverage to be obtained, with the cream persisting on the beverage for several minutes.

Coffee is in fact a food rich in essential oils and at the time of delivery of the beverage it creates an emulsion, namely the cream of the coffee. Experimental tests carried out by the applicant have demonstrated that the cream that can be obtained with the cartridge according to the invention is qualitatively superior to that which can be obtained with cartridges of the prior art, whose bottom wall is normally flat or has radially disposed ribs.

Further characteristics of the invention will be made clearer by the detailed description that follows, referring to a purely exemplifying and therefore non limiting embodiment thereof, illustrated in the appended drawings, wherein:

FIG. 1 is an exploded axial section showing a cartridge for coffee according to the invention, the section being taken along the line A-A of FIG. 3;

FIG. 2 is a view like FIG. 1 showing the assembled cartridge;

Figure 3:
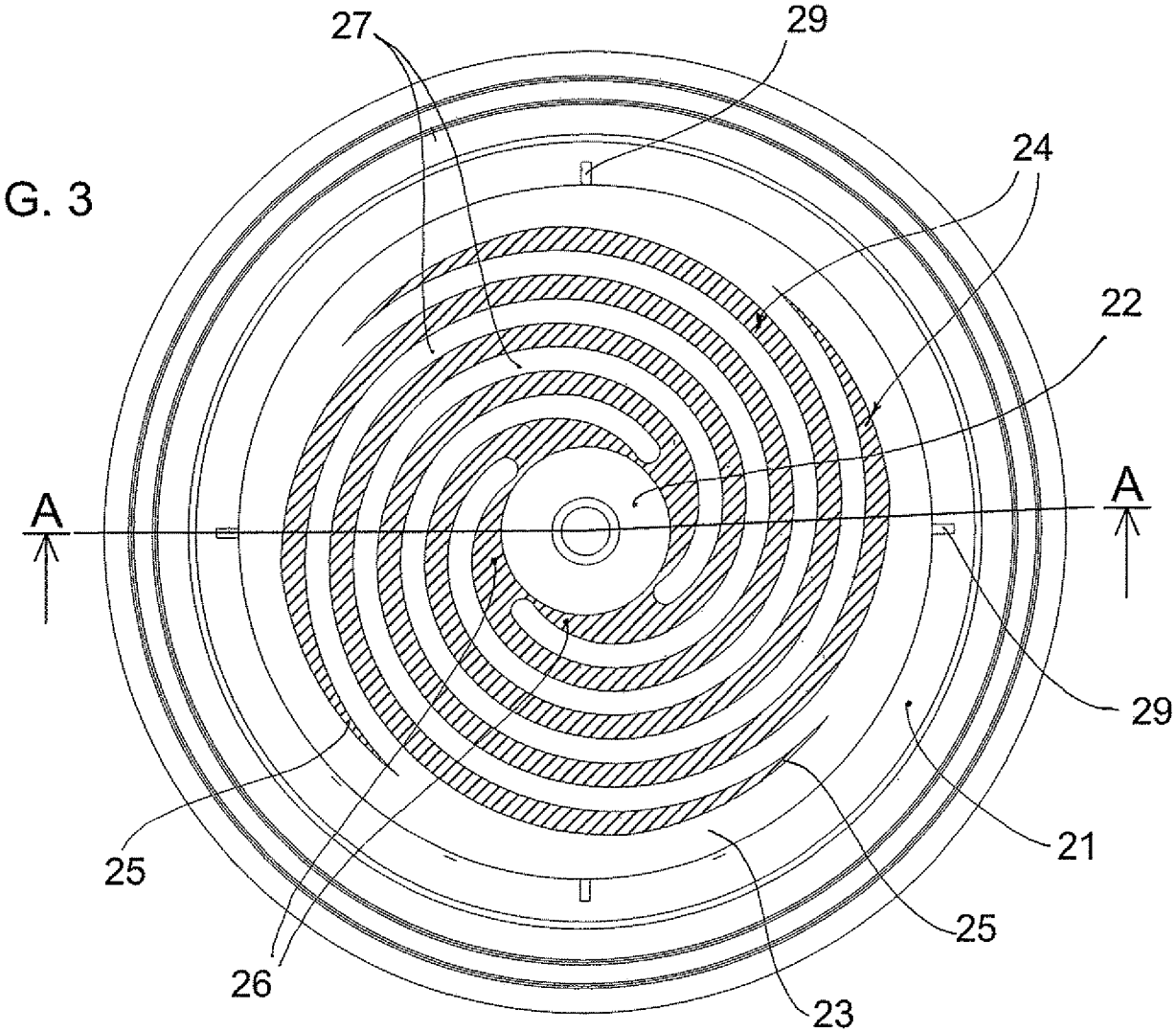
FIG. 3 is a top plan view of the container of the cartridge.

With reference to said figures, the coffee cartridge according to the invention has been indicated as a whole with reference numeral 1.

It comprises a container body 2, frustoconical in shape (but it is obvious that it can also be cylindrical in shape), open at the top and comprising a bottom or lower wall 20, essentially discoid in shape, from which a side wall 21 is erected with a slight upward taper.

The container 2 has on its bottom wall 20 a filter 4, which will be better described further on, and is closed with a lid 6 after having been filled with coffee 100 (FIG. 2).

The bottom wall 20 has a circular-shaped central portion 22, annular in shape in the embodiment illustrated, which is less thick than the remaining part of said bottom wall.

Said less thick, weakened central part 22 of the bottom wall 20 is suitable to be broken for delivery of the beverage, by means of an external mechanical member or by the pressure of the water inside the cartridge, as will be better described further on.

In order to facilitate breaking of said weakened, less thick part 22, especially in the case of this taking place through an increase in the pressure inside the cartridge, cuts or etchings (not shown) that facilitate breakage can be provided thereon.

As can be seen better in FIG. 3 on the bottom wall 20 there is provided a plurality of concentric spiral-shaped grooves 24

(four in the embodiment shown), which start from an annular peripheral edge 23 of the bottom wall, adjacent the side wall 21, and end at said central weakened portion 22.

In particular, as can be seen in FIG. 3, each spiral 24 has a very tapered initial portion 25, at said peripheral edge 23, which starts with a thickness of practically zero, and an enlarged terminal portion 26 (length), which ends in said weakened central part 22 of the bottom wall 20.

The shape of the bottom 22 of the cartridge is such that between said grooved spirals 24 an equal number of raised spirals 27 are defined, which together with said peripheral edge 23, form a base on which the filter 4 rests (see in particular FIG. 2).

Inside the side wall 21 of the container body 2 there is provided a plurality of thickening ribs 29 (four in the embodiment shown) perpendicular to the bottom wall 20 and reaching to about half the height of the container 2.

The purpose of said thickenings 29 is to allow the containers to be stacked one on top of the other without them restraining each other, causing the bottom 20 of a container to abut against the free top ends of said thickening ribs 29.

On the inner surface of the side wall 21, near the bottom 20 of the container 2 there is also provided an annular projection or collar 28, acting as a stop for positioning of the filter 4.

The side wall 21 of the container also has an annular upper edge 30 protruding outwards so as to form a substantially flat upper surface 31.

The container is made in a single body, by injection moulding of rigid plastic material such as plastics for food use and in particular polypropylene or other plastic materials. The bottom wall 20 and the side wall 21 of the container 2 do not have any perforation and have thicknesses designed to ensure that the container 2 has a certain stiffness so as to be able to withstand high pressures for a relatively long time.

The filter 4 is substantially discoidal in shape and has on its peripheral edge a collar 48, able to be positioned beneath the collar 28 formed on the inner surface of the side wall 21 of the container, when the filter is disposed therein, resting on the raised spirals 27 and on the peripheral edge 23 of the bottom wall 20, so that the filter 4 does not obstruct the central portion 22 of the bottom wall of the container and the beverage can circulate freely in the grooved spirals 24 during delivery.

The filter 4 thus positioned, as shown in FIG. 2, is preferably heat bonded to the side wall 2 of the container, at said collars 48, 28.

The filter 4 has on its discoid surface a plurality of conical or truncated pyramid shaped holes 44, suitable for allowing the passage of the beverage from top to bottom and retaining the granular or powdery product above the filter inside the cartridge 1.

When the filter 4 has been positioned on the bottom wall 20 of the container 2, this is filled with coffee 100 or another soluble product and the container is closed with the lid 6, which is fixed to the upper surface 31 of the annular rim 30 by means of heat bonding, ultrasonic bonding, gluing or the like.

The lid 6 can have micro perforations suitable to allow the passage of water and/or steam under pressure. For this purpose the lid 6 may be made from one or more layers of filter paper or one or more strips of micro perforated plastic material.

Alternatively, the lid 6 may have a completely airtight closure, and may optionally be made of rigid plastic material, if the beverage extraction apparatus provides means of perforating said lid.

For delivery of the beverage, the cartridge 1 according to the invention is disposed in a special per se known extracting apparatus such as the one described in the above mentioned patent EP 1364605, if mechanical knocking out of the weakened portion 22 of the bottom 20 of the container is provided, or as described in EP1555218, if knocking out of said weakened portion is to take place through an increase in the water pressure inside the cartridge.

After the cartridge has been positioned in said apparatus, hot water under pressure is introduced through the lid 6 into the cartridge 1, coming into contact with the coffee 100.

When the pressure of the water inside the cartridge reaches a pre-set level, knocking out of the weakened central portion 22 of the bottom 20 of the container takes place, as described above, giving rise to outlet apertures for the beverage, which flows in a special conduit of the apparatus and is collected in a glass or cup beneath.

Before reaching the above mentioned outlet apertures, the beverage is subjected to a swirling movement in said spiral channels 24, which produces a highly emulsifying effect on the beverage flowing out, with the formation of an dense, long-lasting cream.

The applicant has been able to verify that such a result cannot be achieved with the cartridges previously used.

Naturally, the invention is not limited to the particular embodiment previously described and illustrated in the appended drawings, but it is possible to make thereto numerous modifications of detail within the reach of a person skilled in the art, without thereby departing from the scope of the invention as set forth in the appended claims.

The invention claimed is:

1. A cartridge for coffee or soluble products in general for the production of a beverage, comprising:

a container (2) designed to contain the coffee or soluble product, a lid (6) arranged on the container (2) so as to define an upper wall through which hot water under pressure can enter the container to produce the beverage, a filter (4) designed to be positioned inside the container (2) above a bottom wall (20) of the container through which the beverage is extracted, said bottom wall (20) of the container having a weakened less thick central portion (22) designed to be broken by external mechanical means or by the pressure of the liquid inside the cartridge, thereby forming at least one opening to allow the beverage to outflow from the cartridge, wherein the filter is interposed between the bottom wall and the coffee or soluble product such that the coffee or soluble product is not in contact with the bottom wall, plural spiral-shaped grooved channels (24) provided on said bottom wall (20) of the container, which spiral-shaped grooved channels (24) start from a peripheral edge (23) of the bottom wall and end in said weakened central portion (22), a raised spiral (27) intercalated to each said spiral-shaped grooved channel (24) such that the plural spiral-shaped grooved channels (24) are each intercalated by one respective raise spiral (27) on the bottom wall (20), wherein each spiral-shaped grooved channel (24) has a tapering initial portion (25) at said peripheral edge (23) of the bottom wall (20) of the container and an enlarged terminal length (26) ending in said weakened central portion (22), and wherein said filter (4) rests on said raised spirals (27), thereby allowing the swirling outflow of the liquid in said spiral-shaped grooved channels (24).

2. A cartridge according to claim 1, wherein said less thick central portion (22) is circular in shape.

3. A cartridge according to claim 1, wherein said container (2) is frustoconical, cylindrical in shape.

4. A cartridge according to claim 3, wherein thickenings (29) are provided inside the side wall (21) of the container (2), designed to avoid that stacked containers restrain each other, acting as a stop for the bottom (20) of a overhanging container (2).

5. A cartridge according to claim 1, wherein said lid (6) is made of one or more layers of micro-perforated material to allow the passage of hot water under pressure into the cartridge (1).

6. A cartridge according to claim 1, wherein said lid (6) seals the container (2) and is perforated during the beverage delivery.

7. A cartridge according to claim 1, wherein said container (2) is made of plastic material.

8. A cartridge according to claim 1, wherein said less thick central portion (22) is annular in shape.

9. A cartridge according to claim 1, wherein said container (2) is made of polypropylene.

10. A cartridge for coffee or soluble products in general for the production of a beverage, comprising:

a container (2) designed to contain the coffee or soluble product, the container having a bottom wall (20);

a lid (6) arranged on the container (2) so as to define an upper wall through which hot fluid under pressure can enter the container to produce the beverage;

a filter (4) positioned inside the container (2) above the bottom wall (20), wherein the filter is interposed between the bottom wall and the coffee or soluble product such that the coffee or soluble product is not in contact with the bottom wall;

a weakened, less-thick central portion (22) in the bottom wall (20), the weakened, less-thick central portion (22) being breakable by an external mechanical member or by the pressure of the liquid inside the cartridge, thereby forming an opening to allow the beverage to outflow from the cartridge;

a plurality of concentric spiral-shaped grooved channels (24) on the bottom wall (20), the channels starting from a peripheral edge (23) of the bottom wall and ending in the weakened central portion (22); and a raised spiral (27) intercalated to each said channel (24) such that the plurality of channels (24) are each intercalated by one respective raise spiral (27) on the bottom wall (20), wherein each channel (24) has a tapering initial portion (25) at the peripheral edge (23) of the bottom wall (20) and an enlarged terminal length (26) ending in said weakened central portion (22), the channels thereby providing a swirling movement of the liquid during delivery through the channels (24) and out the opening formed in the bottom wall (20), and wherein said filter (4) rests on said raised spirals (27), thereby allowing the swirling outflow of the liquid in said spiral-shaped grooved channels (24).

11. A cartridge for soluble products in general for the production of a beverage, comprising:

a container body to contain the soluble product, the container body having an open top, a bottom wall (20), and a side wall (21) extending with an outward upward taper from the bottom wall to the top;

a lid (6) located on the top of the container body (2) and defining an upper wall through which liquid under pressure enters the container body to produce the beverage;

a filter (4) located above the bottom wall (20), the beverage being extracted through the filter (4) wherein the filter is interposed between the bottom wall and the soluble product such that the soluble product is not in contact with the bottom wall;

a weakened, less-thick central portion (22) in the bottom wall (20), the weakened, less-thick central portion (22) being breakable by an external mechanical member or by the pressure of the liquid to thereby form an opening in the bottom wall (20) that allows the beverage to outflow through the bottom wall (20);

a plurality of concentric spiral-shaped grooved channels (24) located on said bottom wall (20), said channels starting from a peripheral edge (23) of the bottom wall and ending in said weakened central portion (22); and a raised spiral (27) intercalated to each said channel (24) such that the plurality of channels (24) are each intercalated by one respective raise spiral (27) on the bottom wall (20), wherein each channel (24) has a tapered initial portion (25) at said peripheral edge (23) of the bottom wall (20) and an enlarged terminal length (26) ending in said weakened central portion (22), the channels thereby providing a swirling movement of the liquid during delivery through the channels (24) and out the opening formed in the bottom wall (20), and wherein said filter (4) rests on said raised spirals (27), thereby allowing the swirling outflow of the liquid in said channels (24).

* * * * *